US008833479B1

(12) United States Patent
Maust et al.

(10) Patent No.: US 8,833,479 B1
(45) Date of Patent: Sep. 16, 2014

(54) FIRE SUPPRESSION SYSTEM

(75) Inventors: Barry Wayne Maust, Accident, MD (US); Michael Scott Bishoff, Friendsville, MD (US)

(73) Assignee: Pillar Innovations, LLC, Grantsville, MD (US)

( * ) Notice: Subject to any disclaimer, the term of this patent is extended or adjusted under 35 U.S.C. 154(b) by 1154 days.

(21) Appl. No.: 12/215,352

(22) Filed: Jun. 26, 2008

Related U.S. Application Data

(60) Provisional application No. 60/937,359, filed on Jun. 26, 2007.

(51) Int. Cl.
*E21F 5/10* (2006.01)

(52) U.S. Cl.
USPC ..... 169/64; 169/70; 169/16; 239/280; 239/283

(58) Field of Classification Search
USPC ..... 169/64, 70, 16, 17; 239/273, 279–283
See application file for complete search history.

(56) References Cited

U.S. PATENT DOCUMENTS

| | | | | | |
|---|---|---|---|---|---|
| 924,599 | A | | 6/1909 | Byers | 169/46 |
| 1,191,643 | A | | 7/1916 | Wilson et al. | 239/536 |
| 1,282,142 | A | | 10/1918 | Thompson | 239/722 |
| 1,368,269 | A | | 2/1921 | Lemke | 239/723 |
| 2,331,373 | A | * | 10/1943 | Campbell | 285/119 |
| 2,747,933 | A | | 5/1956 | Voigt | 239/240 |
| 2,769,664 | A | | 11/1956 | Cornelius | 239/726 |
| 3,261,369 | A | * | 7/1966 | Thiele | 134/123 |
| 3,684,021 | A | | 8/1972 | Poitras | 239/726 |
| 3,727,694 | A | * | 4/1973 | Dudzik | 169/54 |
| 3,807,635 | A | | 4/1974 | Platt | 239/726 |
| 5,403,141 | A | * | 4/1995 | Rauser | 414/301 |
| 5,909,777 | A | | 6/1999 | Jamison | 169/43 |

* cited by examiner

*Primary Examiner* — Christopher Kim
(74) *Attorney, Agent, or Firm* — The Webb Law Firm

(57) ABSTRACT

A plurality of upstanding bracket assemblies, pipe assemblies, and fasteners are assembled into a plurality of modular fire suppression stations for use in the fire suppression system for a conveyor in an underground mine. Each station includes an upstanding bracket assembly, a fastener, a pipe assembly, and at least one sprinkler head. The fastener attaches the bracket assembly to the conveyor. The pipe assembly is supported by the bracket assembly. The pipe assembly receives water under pressure and directs the water to the sprinkler head. The sprinkler head directs the water onto the conveyor.

10 Claims, 11 Drawing Sheets

FIRE SUPPRESSION SYSTEM

CROSS REFERENCE TO RELATED APPLICATION

This application claims the benefit of U.S. Provisional Application No. 60/937,359 filed on Jun. 26, 2007, the disclosure of which is incorporated herein by reference.

BACKGROUND OF THE INVENTION

1. Field of the Invention

This invention relates to a fire suppression system and, more particularly, to a method and apparatus for suppressing and extinguishing conveyor fires in an underground coal mine.

2. Description of the Related Art

Coal is mined because it will burn and, therefore, is a major source of economical energy. Unfortunately fires occur in underground coal mines. These fires are a threat to the lives of miners. Fires cause great financial losses to the mining companies. According to the Mining Safety and Health Administration, there were 271 reportable fires in underground coal mines in the United States during the ten year period from Jan. 1, 1978 through Dec. 31, 1987. Fortunately most of these fires were handled promptly so the losses were small, but some were not.

Burning coal can be effectively and quickly controlled with water applied as a fire hose stream. If the fire is not discovered quickly or if the fire fighting was not started in good time, this may not work. Fire hose streams have limited range in the restricted height of a mine. The fire almost always takes the course that the ventilation follows. It can only be approached from the upwind side. The downwind side of a fire that has spread to the coal is full of smoke and very hot. The heat of a mine fire also weakens the mine roof, which may cause the roof to cave.

All underground mines (not just coal mines) must include circulating fresh air so that the miners can work. The mining of coal almost always releases methane gas from the coal seam. Breaking the coal from the seam, which really is the mining operation, may release combustible methane gas. Air movement or ventilation is required to dilute the methane to a safe noncombustible concentration and carry the methane-air mix to the surface.

The coal mine is ventilated with "intake air" through a network of "entries" or tunnels in the coal seam. When the intake air reaches the "face" where the actual mining takes place and dilutes and carries away the methane, the air is then called "return air". Return air is directed into "returns" or "return entries" which conduct the return air to the surface.

The return air is not allowed to contact equipment that might ignite a methane-air mix. The only equipment allowed in the face area and in a return must be "permissible" which means that it has been tested and found to be flameproof. Equipment that will be used only in intake entries does not have to be permissible, but much of the electrical equipment will be dusttight.

It should be apparent that in mining or developing entries, there must be at least two entries, an intake and a return, which must have ventilation. Also, in the production area or "section" where the actual mining is taking place there must be connections for the air to flow between the intakes and the returns. These connecting entries are called "crosscuts".

Crosscuts are usually spaced about every 100 feet. When the entries have advanced about 100 feet beyond a crosscut, the next crosscut will be started. When this crosscut is finished, the one behind will be closed to ventilation, eventually with a concrete block or metal wall called a "stopping". In actual practice, there are almost always three or more entries in a section, usually about 100 feet apart, driven with crosscuts between entries.

Modern coal mines can be classified by the mining system used to extract the coal. Virtually all coal mines use powerful "continuous miners" to drive openings in the coal seam.

These machines break the solid coal into pieces so that it can be hauled and/or conveyed to the surface. The openings made are the entries and crosscuts referred to above. Two of the most used mining systems are the longwall mining system and the block or room and pillar system.

Development, or the driving of entries and crosscuts, for the longwall system usually requires driving four, three, or sometimes only two entries with the necessary crosscuts between these entries. Since the entries have different functions and ventilation, usually all of the crosscuts between the entries will be sealed with stoppings to prevent the ventilation air currents from flowing from one entry to its adjacent entry, unless this is needed. These stoppings are effective barriers to a fire in one of the entries and will prevent the fire from spreading to the adjacent entry, at least for a reasonable time.

In contrast, the block system involves driving a larger number of parallel entries, often eight or ten and sometimes even more. With this multiplicity of entries, many will remain connected through open crosscuts and will share the ventilation. A fire in one of the connected entries will tend to stay in the originating entry as it will follow the ventilation, but with the expansion of the hot gases that have gone through the fire zone, the heat and smoke can move into adjacent open entries. Usually it is just a matter of time until the active fire will spread to adjacent entries, unless steps are taken to prevent this spread.

The statistics of fires in underground coal mines are obviously inadequate as only fires that have existed for thirty minutes or more must be reported. Many reports of fires which did burn well over thirty minutes describe scenarios of the fire getting beyond the range of the fire hose streams.

Prior to 1960 virtually all of these fires had to be sealed. Sealing is very expensive as the mine must remain sealed, often for four to six months, to allow the heat of the fire to cool and avoid rekindling when ventilation is restored in the fire area.

In a 1960 fire the new tool of high expansion foam, conceived in Great Britain and developed and tested in the United States, controlled a fire that had spread over an area so that 4100 lineal feet of entries and crosscuts were burning. The foam equipment operated almost continuously for three days. This fire probably was the largest mine fire that was ever controlled by direct fire fighting.

Unfortunately only about sixty of the large high expansion foam generators similar to the one used on the above described fire have been purchased by the coal industry. They are not inexpensive as the current price for the generators, which must be tailor made for the mine, is in the order of thirty to forty-five thousand dollars. Many smaller and less refined generators are commercially available. Based on the fire reports available in the United States, these smaller and less expensive machines have never been successful in controlling a fire that spread to the coal. The result has been that some fires were not fought successfully using this advanced fire-fighting technique because the foam equipment was unavailable, inadequate, or mishandled.

It is also important to consider the manner in which non-reportable fires have been controlled and also why these techniques have failed in other instances. Because quick response to a fire is so important, virtually all fires that are extinguished are fought by persons who were at or in the vicinity of the fire when it started. If extinguishers are used quickly enough, they can extinguish the fire while it is still small. When the fire spreads to the coal, a fire hose stream can extinguish the fire if it has not spread beyond the range of the hose streams. The rate at which the fire will spread to the coal is greatly affected by the size of the starting fire, the height of the coal seam, the presence of a coal top or "roof", and the percent volatile of the coal.

Fires seldom get out of control in low seam mines, which usually have noncombustible roof. If the volatile content of the coal is low, the coal will not ignite readily and the rate a fire will spread is slow. These conditions which slow the spread of the fire provide more time to assemble the personnel and equipment needed to fight the fire. The advance of the firefighters is usually fast enough so that they can overtake the leading edge of the fire and extinguish it.

In contrast, the opposite will occur in coal mines having thick seams with high volatile coal, especially at the mine roof. The coal ignites readily, and the fire grows and moves downwind rapidly. This fire situation must be handled very quickly and competently with fire hoses before it gets beyond the range of a hose stream.

Since the maximum range of a fire hose adjusted to a solid stream in high coal is in the order of 40 to 50 feet, the fire will be large before it gets away from the fire hose streams. Because the fire is large and active, the downwind side of the fire is very hot with dense smoke. In the past attempts have been made to set a fire hose in a crosscut on the downwind side of the fire close to the entry to stop the fire, but the published fire reports indicate that these attempts have not been successful in difficult fire situations.

It is important to understand the conditions that make it difficult to fight fires in a coal mine. The amount of air that reaches the upwind side of the fire is the amount needed to provide safe conditions for the firefighters who are using the fire hoses. Usually, the ventilation air velocity must be in the order of 200 to 300 feet per minute (fpm) to prevent the smoke from the fire from moving back against this fresh air. Higher velocity will feed the fire and cause it to grow rapidly. Air velocity of 200 to 300 fpm is sufficient to feed a large fire. Accordingly, several devices for detecting and suppressing underground fires have been developed.

U.S. Pat. No. 3,684,021 discloses apparatus for detecting and suppressing a potentially dangerous flame from moving away from a mine face and down a mine tunnel. A flame extinguishing agent is not discharged upon the occurrence of ignition of small pockets of either methane or coal dust adjacent the mine face. As a rule most of the flames ignited adjacent the mine face terminate quickly or are extinguished by water from spray equipment mounted on the mining machine for suppressing dust and maintaining the cutter bits cool during the material dislodging operation.

U.S. Pat. No. 3,684,021 discloses that once a flame progresses from the mine face and advances in the entry where it begins to be fueled by ventilation air, the advancing flame is detected. A flame suppressing agent is then discharged ahead of the advancing flame. The agent completely fills the cross-sectional opening of the entry. When the flame reaches the area of the entry filled with the extinguishing agent, the flame is quenched and prevented from igniting an explosive mixture of airborne coal dust and/or methane gas.

U.S. Pat. No. 924,599 also discloses a method of extinguishing fires in a mine by sealing off the advancing flame. Upon the occurrence of a fire, the entrance to a heading is sealed by closing a door and a network of pipes are opened to the entry. An exhaust pump is connected to the network of pipes so that air is drawn out of the entry into the pipes. Consequently the atmospheric pressure in the sealed entry is reduced. The air normally supporting combustion is withdrawn and the fire is extinguished. The network of pipes can also be used to introduce steam to the entry to contribute to the fire suppression.

While it has been proposed to attach a nozzle or spray head to the outlet end of fire hose or pipe and advance the pipe outlet into a confined structure to flood the structure with water to suppress the flame, the known devices, as disclosed in U.S. Pat. No. 2,747,933, are not adaptable for use in fighting fires in an underground mine. It is also known to mount pipes or conduits on wheels to move the conduits to a desired position where water is sprayed from nozzles spaced along the length of the mobile pipe. These types of devices are most commonly utilized in lawn sprinkling systems as disclosed in U.S. Pat. Nos. 1,191,643; 1,282,142; 1,368,269; and 3,807,635.

U.S. Pat. No. 2,769,664 discloses a mobile sprinkler-type irrigation system. This system permits water to be conveyed through a network of pipes to a distance point where water is dispersed in a spray pattern from spaced-apart nozzles. The systems are not adaptable for use in an underground mine to suppress a fire.

U.S. Pat. No. 5,909,777 discloses a water pipe assembly that delivers water under pressure through nozzles to generate a series of intersecting sprays directed at selected angles. The water spray prevents the roof bolts from being heated to an elevated temperature which can cause a loss of anchorage of the bolts in the mine roof. The water curtain also cools the hot gases generated by the fire to stop advance of the fire beyond the curtain so that the fire can be contained and extinguished.

Fire suppression systems for conveyors in underground mines, such as coal mines, are of particular importance. Conveyors require automatic fire suppression systems that meet the requirements set forth by the relevant Mine Safety and Heath Administration regulations. Existing conveyor fire suppression systems typically include conventional fastening systems that attach to various points on or around the conveyor. These systems often fail to meet regulations and may be difficult to install. Violations can occur when systems fail to properly position water discharge devices, fail to include functional piping arrangements, and lack structural integrity. In many cases, skilled fire suppression installers are not available for system installations.

Prepackaged systems provide ease of installation, but do not guarantee the proper orientation of the sprinkler head. With the sprinkler head in an incorrect position, the orifices are susceptible to being clogged by sediment found in the water system and/or water is applied in an inefficient manner.

Other prepackaged systems guarantee the proper positioning of the sprinkler but are cumbersome to install. These systems require detailed information to be analyzed to design a compliant system. Accordingly, there is a need to provide an improved conveyor fire suppression system.

SUMMARY OF THE INVENTION

In accordance with the present invention there is provided a modular fire suppression apparatus for a conveying device. A bracket assembly is provided. A fastener for attaching the bracket assembly to extend in a predetermined relation with the conveying device is provided. A pipe assembly is supported by the bracket assembly in a predetermined position relative to the conveying device. The pipe assembly has an inlet connected to a source of water under pressure at one end and an outlet at the opposite end. A spraying device connects to the pipe assembly outlet for directing water under pressure from the pipe assembly to the conveying device.

Further in accordance with the present invention, there is provided a method for suppressing a fire on a conveyor. A bracket assembly is fastened to the conveyor. The bracket assembly extends to a preselected position relative to the conveyor. A pipe assembly is supported on the bracket assembly in a predetermined spaced relation with the conveyor. An inlet of the pipe assembly is connected to a source of water under pressure and an outlet of the pipe assembly to a sprinkler head. The sprinkler head is supported on the pipe assembly in position to spray the conveyor with water. Water is conveyed under pressure from the pipe assembly inlet through the pipe assembly outlet to the sprinkler head. A spray of water is directed under pressure from the sprinkler head to the conveyor.

Further in accordance with the present invention, there is provided a kit for assembling a modular fire suppression apparatus. A bracket assembly has an upstanding tubular member. A fastener connects the bracket assembly to an underground conveyor. A pipe assembly is supported by the tubular member to extend above the underground conveyor. A coupling connects the pipe assembly to a source of water under pressure. A sprinkler head mounts on the pipe assembly for spraying water under pressure from the pipe assembly onto the conveyor.

Further in accordance with the present invention, there is provided a fire suppression station for an underground mine conveyor. A sprinkler head is positioned for spraying the conveyor. A pipe assembly directs pressurized water from a source to the sprinkler head. A bracket assembly supports the pipe assembly. Means for connecting the bracket assembly to the conveyor are provided.

Further in accordance with the present invention, there is provided a fire suppression system for an underground conveyor. A plurality of stations have a pipe assembly for receiving water under pressure from a source, a bracket assembly for supporting the pipe assembly, a fastener for attaching the bracket assembly to the underground conveyor, and a sprinkler head receiving water from the pipe assembly for spraying the underground conveyor. A monitoring device for connecting to at least one station pipe assembly to measure the flow of water therethrough is provided.

Accordingly, a principal object of the present invention is to provide a modular fire suppression system for an underground mine conveyor.

Another object of the present invention is to provide a fire suppression system that is easily attached to an underground mine conveyor.

Another object of the present invention is to provide a fire suppression system that is easily installed in an underground mine.

A further object of the present invention is to provide a fire suppression kit for an underground mine conveyor.

These and other objects of the present invention will be more completely described and disclosed in the following specification, accompanying drawings, and appended claims.

DESCRIPTION OF THE PREFERRED EMBODIMENTS

The present invention is employed with a wide variety of conveyors and conveying devices that are used in above-ground or underground applications. The invention is particularly adapted for use with conveyors in underground mining applications. Such conveyors include hanging conveyors that are suspended with chains to hang from a mine roof. Such conveyors also include conveyors that rest on a mine floor. The conveyors include frames that are assembled from beams, pipes, wire rope, or a combination thereof.

Figure 1:
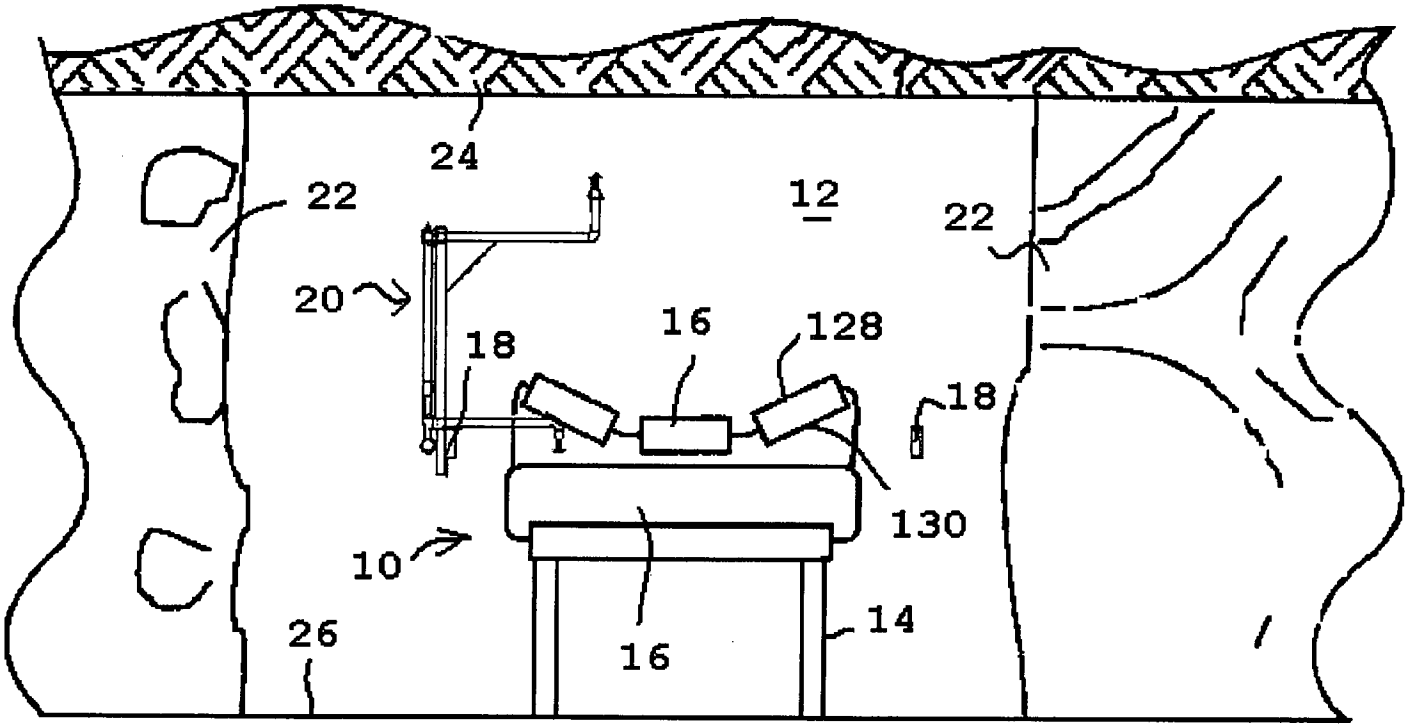
FIG. 1 is a schematic fragmentary elevational view of a conveyor and fire suppression system station positioned within an underground mine.
Figure 2:
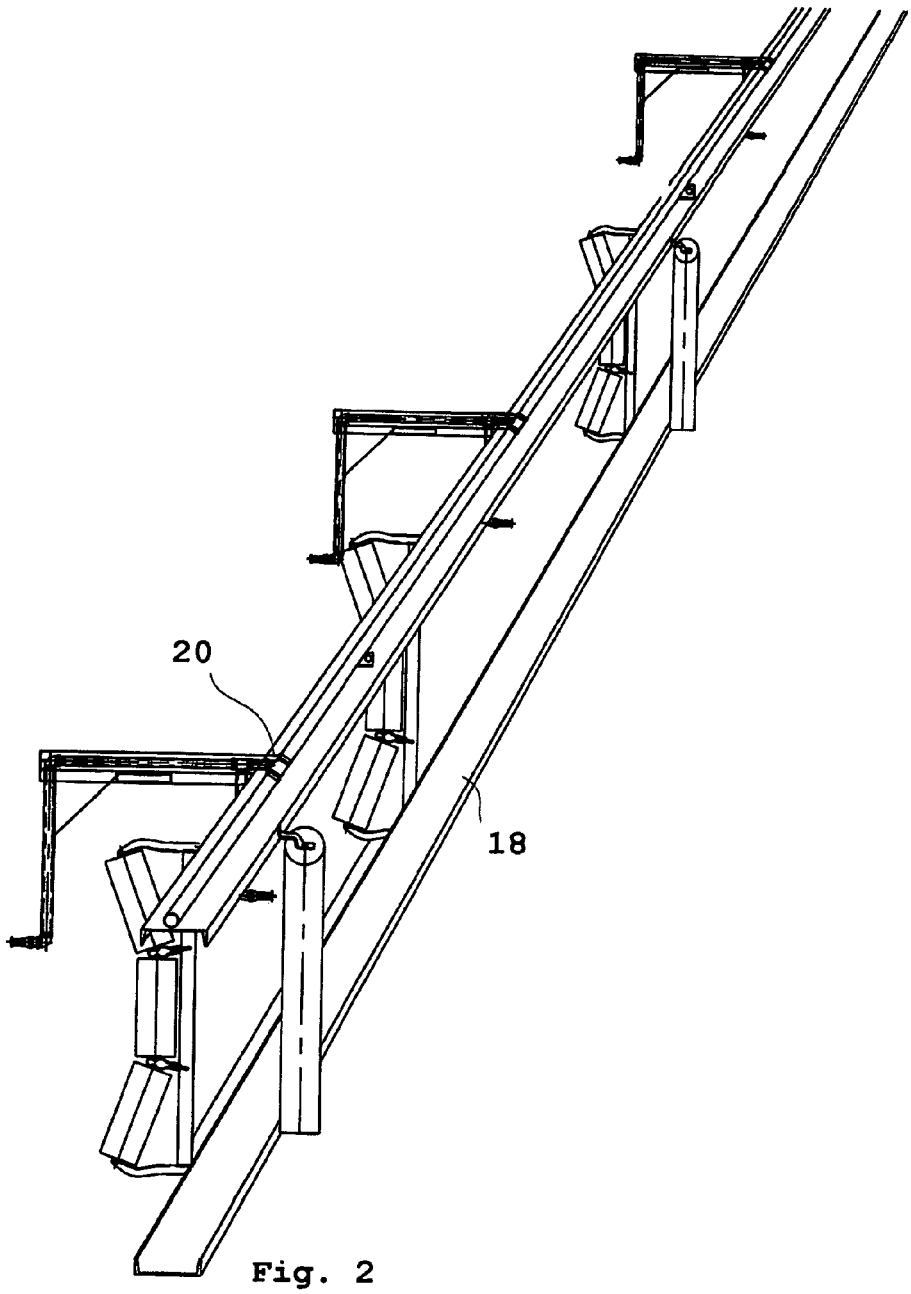
FIG. 2 is a fragmentary isometric view of the fire suppression system station shown in FIG. 1 connected to a beam on the conveyor.

Referring to the drawings and particularly to FIGS. 1-2, there is illustrated a conveyor 10 positioned within an entry or crosscut 12 in an underground mine. The entry or crosscut 12 is cut into a coal seam through conventional mining methods. The conveyor 10 includes a base 14, a plurality of belts 16, and a pair of support beams 18. An automatic fire suppression system station or module generally designated by the numeral 20 is connected to the conveyor 10. Preferably, the conveyor 10 is a conventional coal mine channel conveyor that is well known in the art.

As shown on FIG. 1, each entry or crosscut 12 is defined by sidewalls or ribs 22. A roof 24 extends over and across the entry or crosscut 12. The roof 24 is usually reinforced by conventional roof support systems (not shown). A mine floor 26 is formed at the base of the entry or crosscut 12. With this arrangement operating personnel, equipment, and mined material are moved and transported in the mine through the entries or crosscuts 12.

Figure 4:
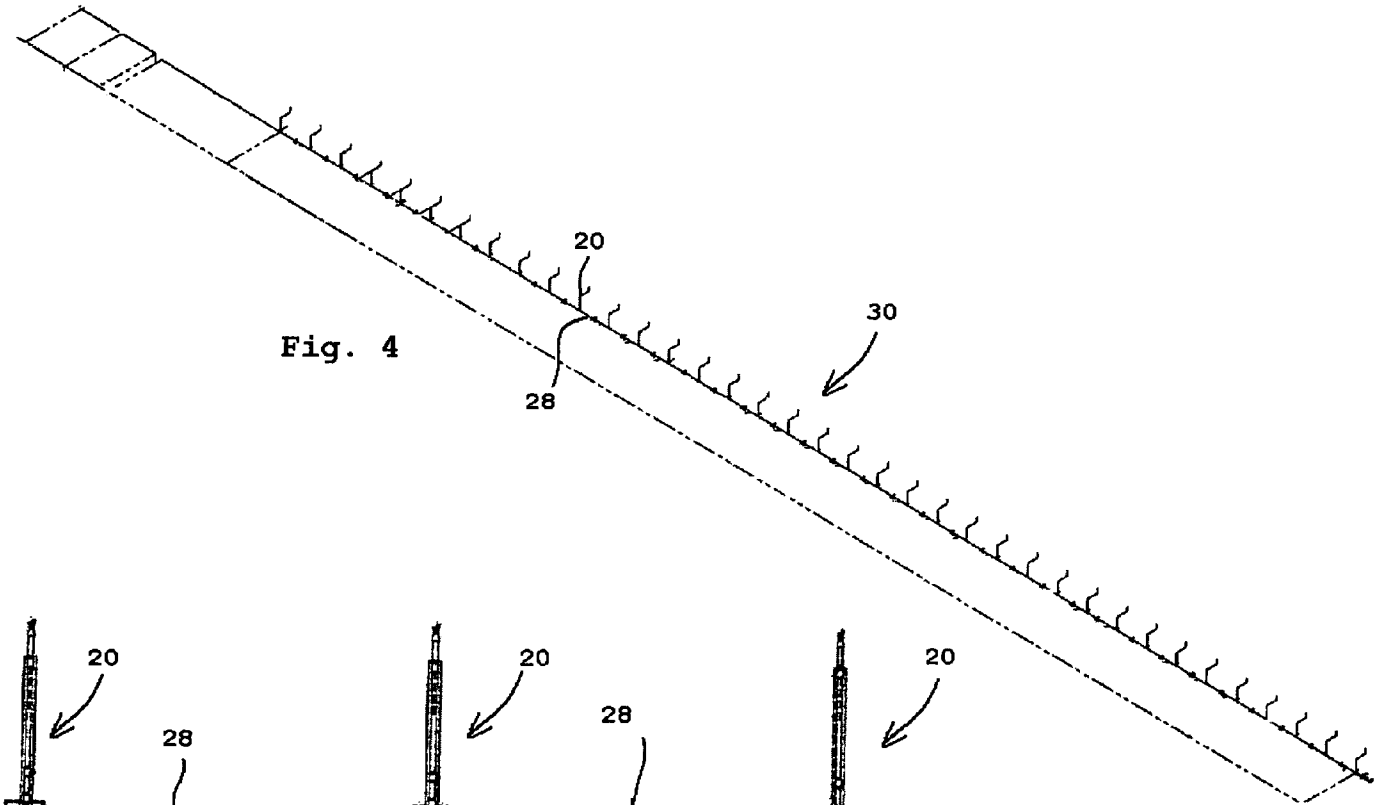
FIG. 4 is a schematic layout view of a fire suppression system for an underground mine conveyor, illustrating a plurality of fire suppression system stations positioned the length of the conveyor.
Figure 3:
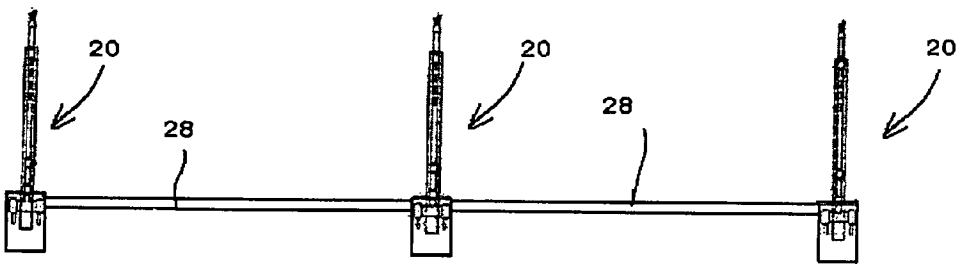
FIG. 3 is an elevational view of a plurality of spaced apart fire suppression system stations connected to one another.

Referring now to FIGS. 3-4, a plurality of fire suppression stations 20 are connected to one another with pipes 28 to form a modular fire suppression system 30. The system 30 is designed for the mining industry to provide rapid installation of modules based on the length and construction of the conveyor 10. The installation of the modules in the system 30 also minimizes conveyor down time, the amount of manpower and tools that are needed because each station module 20 in the system 30 is installed with a single open end wrench.

Each modular fire suppression station system 20 is positioned to provide a water sprinkler or sprinkler head at a predetermined location along the length of the conveyor 10 shown in FIG. 1. Preferably, the stations 20 are positioned at intervals between six feet and eight feet apart, but the distances are not critical.

The system 30 connects to a water source (not shown) to provide fire protection above the belts 16, between the belts 16, and to areas adjacent to the conveyor 10, as shown in FIG. 1. Drive protection stations (not shown) are also available to provide direct coverage of drive motor units (not shown) of the conveyor 10.

Referring now to FIGS. 5-9, the fire suppression system station 20 includes a bracket assembly 32, fasteners 34, a pipe assembly 36, and a plurality of sprinkler heads 38, 40. The fasteners 34 connect to the bracket assembly 32 to attach the station 20 to one of the beams 18 shown in FIG. 2. The bracket assembly 32 extends upwardly from the underground conveyor 10 shown in FIG. 1.

The bracket assembly 32 supports the pipe assembly 36 above the belts 16. The pipe assembly 36 is connected to a supply of pressurized water 42 as diagrammatically shown in FIG. 10 at one end. The pipe assembly 36 is connected to the sprinkler heads 38, 40 at the opposite end. The sprinkler heads 38, 40 are positioned to receive water from the pipe assembly 36 for spraying the belts 16 to lower the temperature and to suppress fires. The sprinkler heads 38, 40 are positioned in a manner to prevent cold soldering, which occurs when one sprinkler head prevents another sprinkler head from discharging.

Figure 5:
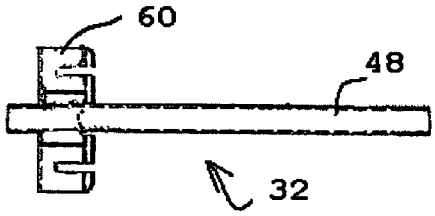
FIG. 5 is a top plan view of a bracket assembly for the station shown in FIG. 1.
Figure 6:
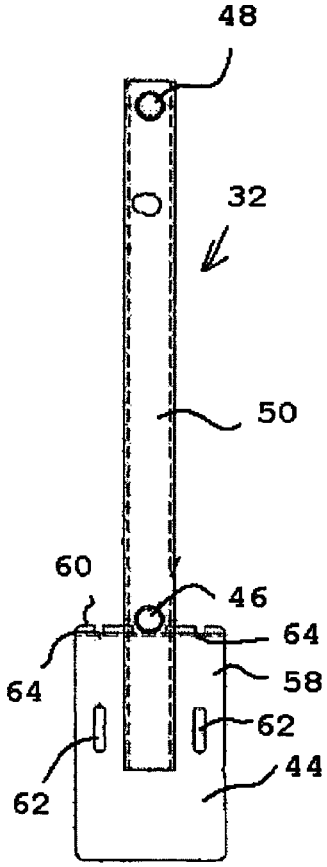
FIG. 6 is an elevational view of the bracket assembly shown in FIG. 5.
Figure 7:
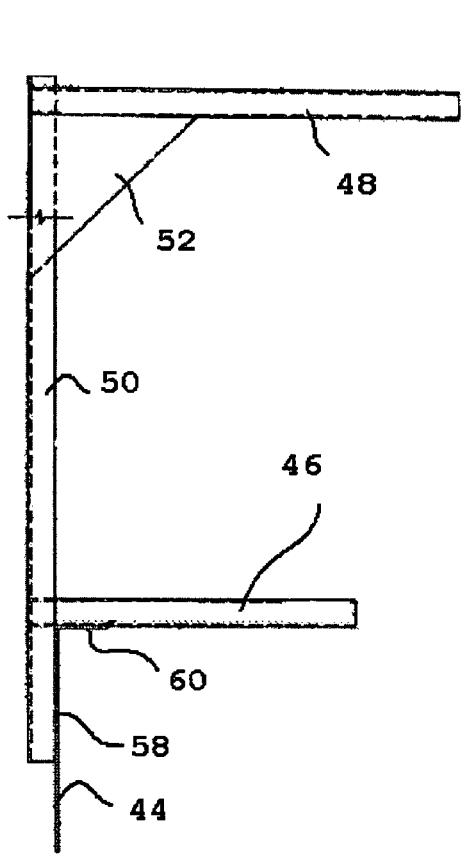
FIG. 7 is a side view of the bracket assembly shown in FIG. 5.

As shown in FIGS. 5-7, the bracket assembly 32 includes a bracket 44, a pair of tubular horizontal members 46, 48, a vertical support column 50, and a gusset 52. The bracket 44 is connected to the horizontal member 46 and to the vertical support column 50 by conventional fastening methods. The vertical support column 50 connects to the horizontal member 46 and to the horizontal member 48 by conventional fastening methods. The gusset 52 connects the vertical support column 50 to the horizontal member 48 to provide additional support and rigidity to the horizontal member 48.

Figure 9:
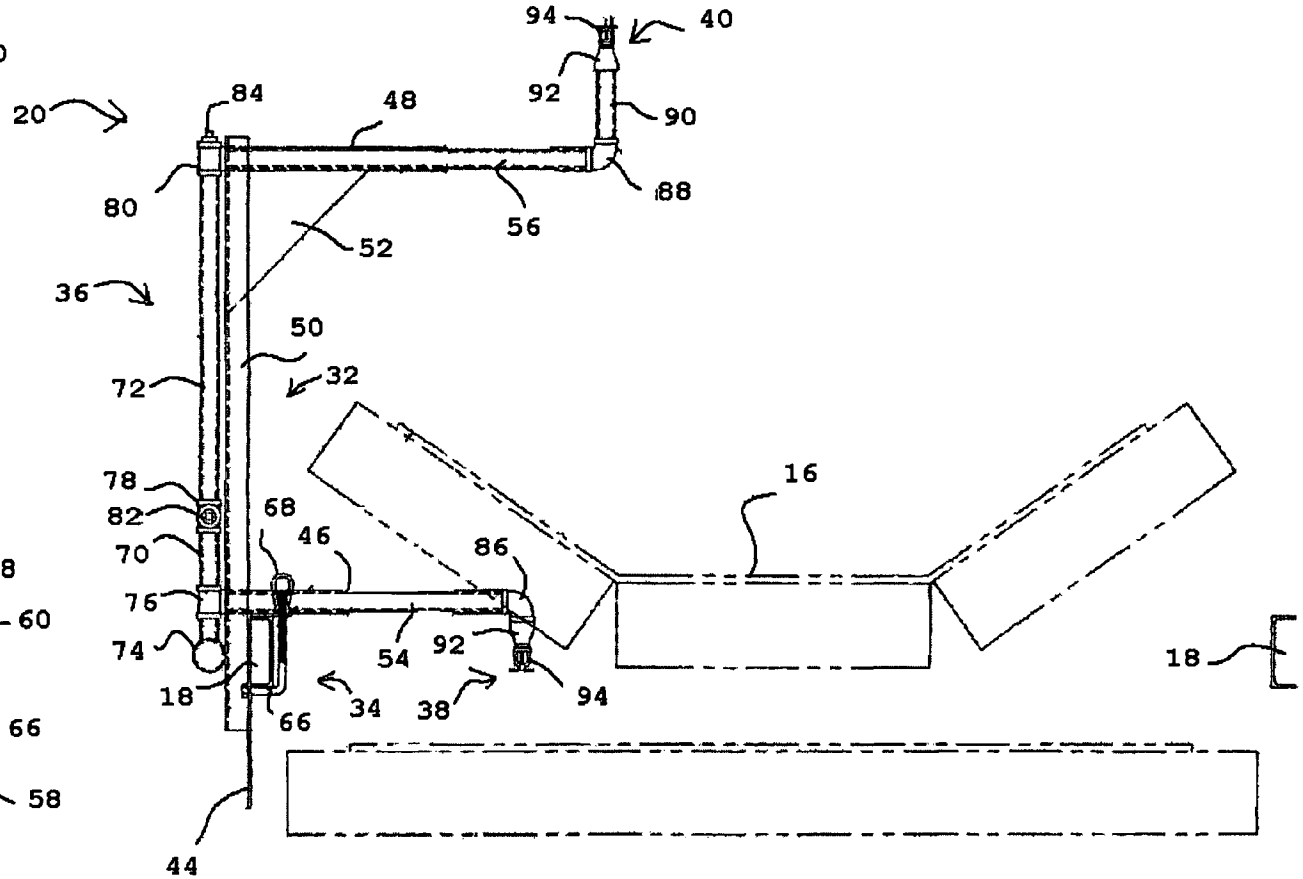
FIG. 9 is a side view of the station shown in FIG. 8, illustrating an underground conveyor in dashed lines.
Figure 8:
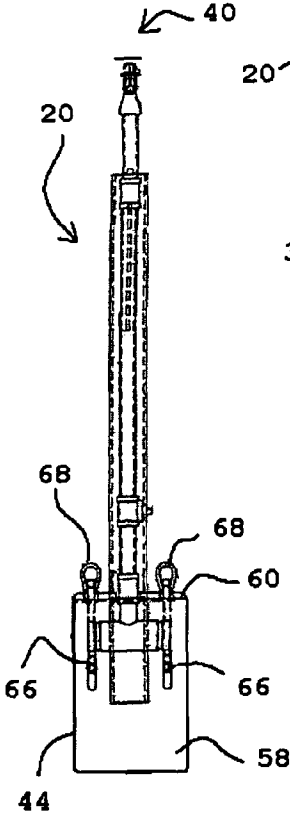
FIG. 8 is an elevational view of the fire suppression system station shown in FIG. 1.

Referring now to FIGS. 8-9, the pipe assembly 36 includes a pair of sprinkler pipes 54, 56 that are inserted into the horizontal members 46, 48 to connect the pipe assembly 36 to the bracket assembly 32. A pair of fasteners 34 also connects the pipe assembly 36 to the bracket 44 to clamp the station 20 to the conveyor 10 shown in FIG. 1.

As shown in FIGS. 8-9, the bracket 44 includes a vertical plate 58 and a horizontal plate 60. The vertical plate 58 is essentially perpendicular to the horizontal plate 60. The vertical plate 58 includes a pair of slots 62, as shown in FIG. 6. The horizontal plate 60 also includes a pair of slots 64, as shown in FIG. 6. Each fastener 34 includes a j-bolt 66 and a loop nut 68. Each j-bolt 66 inserts through one of the slots 62 and into one of the slots 64 connecting the pipe assembly 36 to the bracket 44. The j-bolts 66 and the bracket 44 also wrap around one of the beams 18 to connect the station 20 to the conveyor 10.

Figure 10:
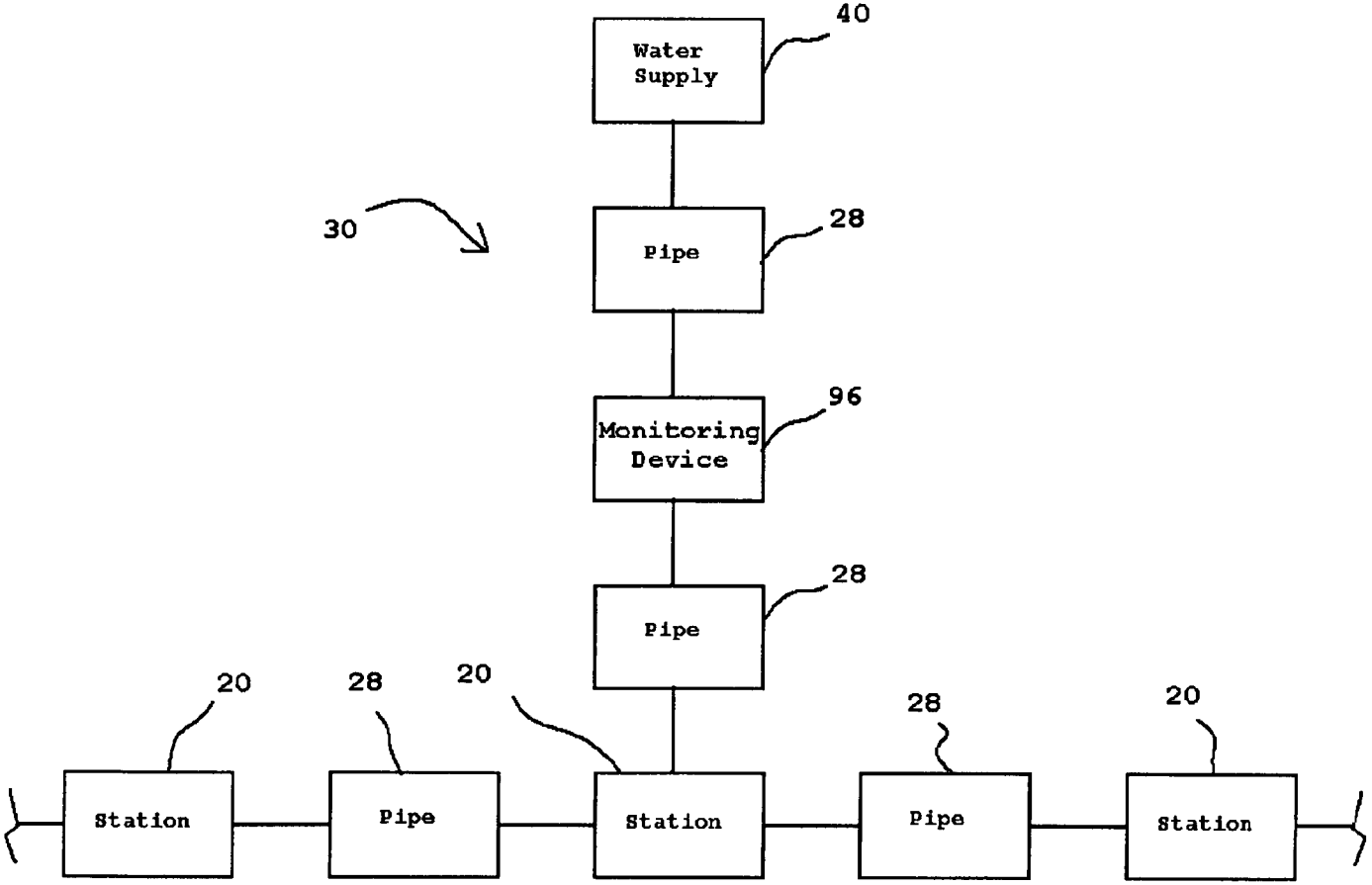
FIG. 10 is a block diagram of the fire suppression system, illustrating the monitoring device for the system.

As shown in FIG. 9, the pipe assembly 36 also includes a plurality of standing pipe sections 70, 72 and plurality of couplings 74, 76, 78, 80 for transporting water from the source 40 diagrammatically shown in FIG. 10 to the sprinkler pipes 54, 56. The couplings 74, 76, 78, 80 are arranged in manner to prevent the sprinkler heads 38, 40 from being silted as water flows from the source 40.

The pipe assembly 36 is provided in an assembled form with the bracket assembly 32, the fasteners 34, and the sprinkler heads 38, 40. The coupling 74 connects to the pipes 28 to install the station 20 in the system 30, as shown in FIGS. 3-4. Alternatively, the station 20 is provided in an unassembled kit or a partially assembled kit. The bracket assembly 32 and the pipe assembly 36 are available in a preassembled form, partially assembled forms, or in unassembled kits.

The coupling 74 connects to the coupling 76 to provide water to the pipe assembly 36. The coupling 76 connects to the vertical pipe section 70 and to the horizontal sprinkler pipe 54. The vertical pipe section 70 connects to the coupling 78. The coupling 78 connects to the vertical pipe section 72. The vertical pipe section 72 connects to the coupling 80 to provide water to the horizontal sprinkler pipe 56. The coupling 78 includes a plug 82 for closing openings that are not in service. The coupling 80 also includes a plug 84. The plugs 82, 84 provide the ability to expand the system 30 shown in FIGS. 3-4, as needed. Alternatively, coupling 80 and plug 84 are replaced by an elbow joint (not shown) to connect pipe section 72 to sprinkler pipe 56. Coupling 78 and plug 82 are replaced by a solid throughpipe (not shown), so that pipe 72 directly connects to pipe 70.

As shown in FIG. 9, the pipe assembly 36 also includes a pair of elbows 86, 88 and a sprig or sprinkler head support member 90 for transporting water from the sprinkler pipes 54, 56 to the sprinkler heads 38, 40. The elbow 86 connects the sprinkler pipe 54 to the sprinkler head 38. The elbow 88 connects the sprinkler pipe 56 to the sprig 90, which is attached to the other sprinkler head 40.

Each of the sprinkler heads 38, 40 shown in FIG. 9 includes an adapter 92 and a sprinkler head 94. The sprinkler heads 38, 40 receive water from the pipe assembly 36 for spraying on the belts 16. The sprinkler head 38 is positioned between the belts 16. The sprinkler head 40 is positioned above the belts 16.

The bracket assembly 32, the fasteners 34, the pipe assembly 36, and the sprinkler heads 38, 40 are fabricated by any suitable manufacturing method using any suitable materials. Preferably, the bracket assembly 32 and the fasteners 34 are made from steel, and the pipe assembly 36 and the sprinkler heads 38, 40 are made from galvanized metal.

Figure 11:
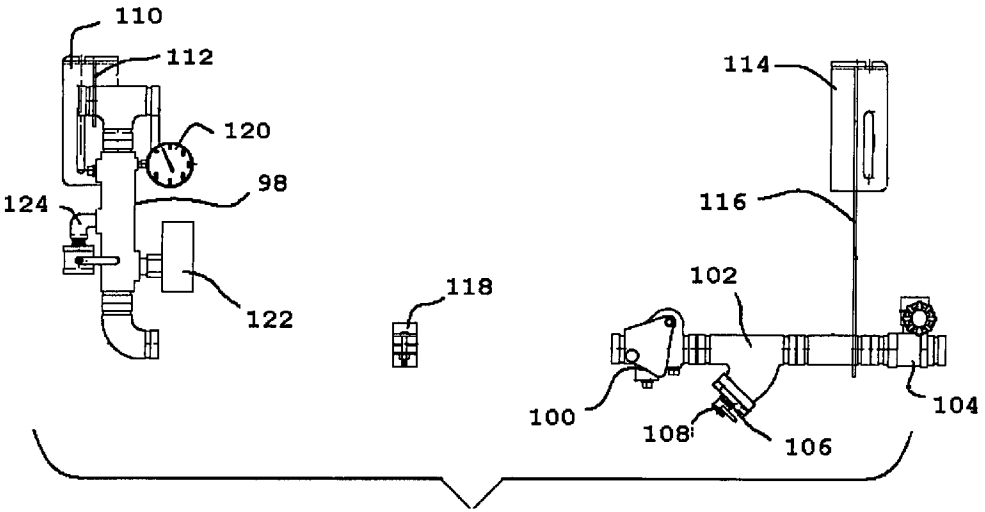
FIG. 11 is an exploded elevational view of the monitoring device for the fire suppression system shown in FIG. 10.

Referring now to FIGS. 10-11, the system 30 includes a monitoring device 96. The monitoring device 96 includes a manifold assembly 98, a check valve 100, a strainer 102, and a butterfly valve 104. The strainer 102 captures large foreign objects prior to entering into the pipe assembly 36 shown in FIGS. 8-9. The strainer 102 is supplied with a nipple 106 and a ball valve 108 for quick removal of strained objects. The check valve 100 prevents water that has entered the pipe assembly 36 from reentering the system 30.

The manifold assembly 98, as shown in FIG. 11, is mounted at a predetermined position utilizing a mounting bracket 110 and a plate 112. The check valve 100, the strainer 102, and the butterfly valve 104 are mounted utilizing a mounting bracket 114 and a plate 116. A coupling 118 connects the manifold assembly 98 to the check valve 100. Preferably, the coupling 118 is a Grinell coupling or other brand name coupling.

The manifold assembly 98 includes a pressure gauge 120 for indicating the amount of pressure in the system 30. The manifold assembly 98 also includes a flow switch 122 that provides dry contacts for monitoring the flowing of water moving through the system 30. The switch 122 provides a remote signal and has the ability to automatically stop the conveyor 10.

The manifold assembly 98 also includes a two position valve 124. In the first position, the valve 124 simulates the flow of a sprinkler head, which allows testing of the flow switch 122 for functionality. In the second position, the valve 124 opens the system for draining purposes.

The monitoring device 96 allows visual verification of the position of the valve 124, which provides means for disabling the water supply for maintenance and system modification purposes. Optionally, electric contacts (not shown) are provided to allow for monitoring of the valve 124 through electronic means (not shown).

Figure 12:
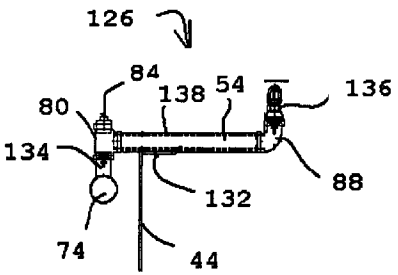
FIG. 12 is an elevational view of another embodiment of a fire suppression system station, illustrating a sprinkler head positioned to spray the bottom of the top conveyor shown in FIG. 1.

Now referring to FIG. 12, there is shown another embodiment of a fire suppression system station, generally designated by the numeral 126, in which like elements are identified by like numerals shown in FIGS. 1-11. The station 126 is adapted to discharge water that impinges the bottom of the top conveyor belt 128 shown in FIG. 1.

Typically, the edge 130 of the top belt 128 is turned upward to form a U-shaped trough in the manner shown in FIG. 1. The station 20 does not direct water onto the portion of the belt 128 that is turned upward on the opposite side of the station 20. The station 126 shown in FIG. 12 is installed on the opposite side of the conveyor 10 shown in FIG. 1 at predetermined positions where the belt 128 must be wetted.

As shown in FIG. 12, the station 126 includes a bracket assembly 132, a pipe assembly 134, and a sprinkler head 136. The pipe assembly 134 includes a tee 74 that has a vertically aligned outlet to prevent sediment from entering the sprinkler head 136. The bracket assembly 132 includes a tubular horizontal member 138 and a bracket 44 for connecting the station 126 to the conveyor 10 shown in FIG. 1.

The bracket assembly 132 and the pipe assembly 134 position the sprinkler head 136 in a manner that prevents the sprinkler head spray pattern from impinging the spray pattern of the sprinkler head 38 shown in FIG. 9. This arrangement prevents cold soldering.

Figure 13:
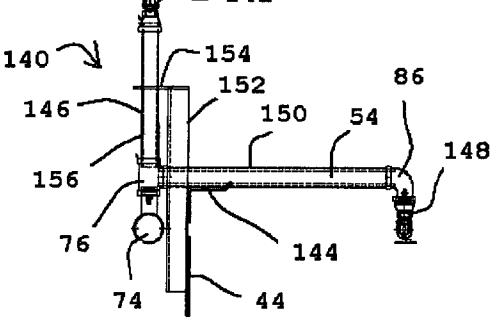
FIG. 13 is an elevational view of another embodiment of a fire suppression system station that provides fire suppression in locations where a sprinkler head cannot be extended over the conveyor shown in FIG. 1.

Referring now to FIG. 13, there is shown another embodiment of a fire suppression system station, generally designated by the numeral 140, in which like elements are identified by like numerals shown in FIGS. 1-12. The station 140 is adapted for mine locations where a sprinkler head 142 cannot be extended over the conveyor belts 16 shown in FIG. 1

The station 140 is also adapted to provide water coverage between the conveyor belts 16 shown in FIG. 1. Optionally, a pair of stations 140 will be installed on opposite sides of the conveyor 10 in a staggered pattern to provide a preselected spray pattern.

The station 140 includes a bracket assembly 144, a pipe assembly 146, and a pair of sprinkler heads 142, 148. The bracket assembly 144 includes a horizontal tubular member 150, an adjustable vertical support column 152, and a slotted plate 154. The pipe assembly 146 includes a pair of couplings 74, 76, a horizontal sprinkler pipe 54, and a vertical sprinkler pipe 156.

The horizontal sprinkler pipe 54 is connected to the sprinkler head 148. The vertical sprinkler pipe 156 is connected to the sprinkler head 142. The horizontal sprinkler pipe 54 inserts into the horizontal tubular member 150 to connect the bracket assembly 144 to the pipe assembly 146. The vertical support column 152 is adjustable to accommodate vertical sprinkler pipes 156 of varying lengths.

Figure 15:
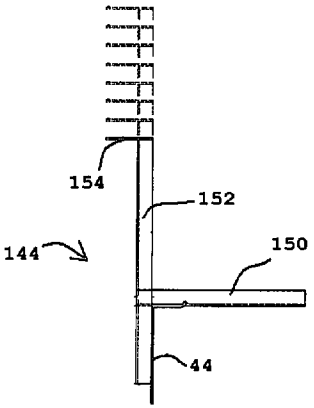
FIG. 15 is an elevational view of the bracket assembly shown in FIG. 14, illustrating adjustable positions in the height of the bracket.
Figure 14:
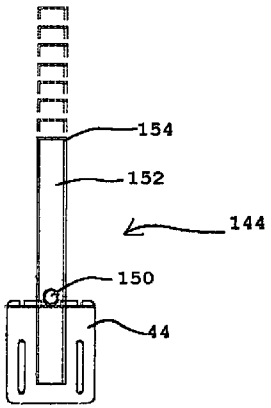
FIG. 14 is a view of a bracket assembly for use in a fire suppression system that provides adjustability in the positioning of the fire suppression system in mine locations where the mine ceiling is close to the surface of the conveyor.
Figure 16:
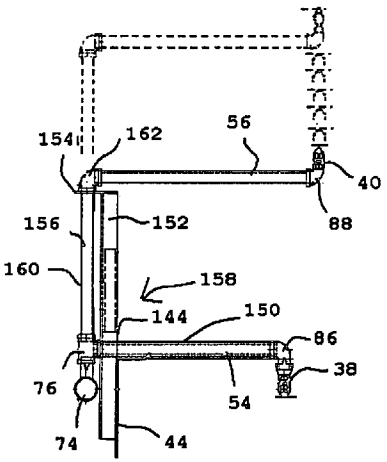
FIG. 16 is an elevational view of an embodiment of a fire suppression system station having the bracket assembly shown in FIG. 14, illustrating alternate positions in the height of the sprinkler head above the conveyor.

Now referring to FIGS. 14-16, there is shown another embodiment of a fire suppression system station, generally designated by the numeral 158, in which like elements are identified by like numerals shown in FIGS. 1-13. The vertical support column 152 as shown in FIGS. 14-16, positions the sprinkler head at selected elevations above the conveyor. The variable positions are shown in phantom in FIGS. 14-16. With this arrangement the station 158 provides fire suppression in mine locations where the mine ceiling is close to the conveyor.

The station 158 shown in FIG. 16 includes a bracket assembly 144 and a pipe assembly 160. The pipe assembly 160 includes a pair of couplings 74, 76, a pair of horizontal sprinkler pipes 54, 56, a vertical sprinkler pipe 156, and a plurality of elbows 86, 88, 162. The elbow 162 allows the horizontal sprinkler pipe 56 to rotate about the vertical sprinkler pipe 156 out of the path of an object (not shown) traveling at a predetermined height on the conveyor belt 128 shown in FIG. 1.

Figure 17:
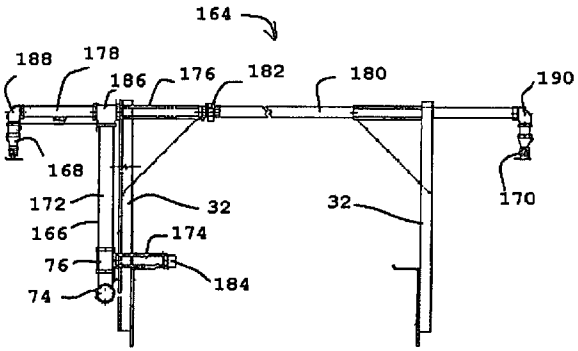
FIG. 17 is an elevational view of an embodiment of a fire suppression system station positioned to provide fire suppression at a head pulley of the conveyor.

Referring now to FIG. 17, there is shown another embodiment of a fire suppression system station generally designated by the numeral 164 in which like elements are identified by like numerals shown in FIGS. 1-16. The station 164 provides fire suppression for a head pulley (not shown).

The station 164 includes a pair of bracket assemblies 32, a pipe assembly 166, and a pair of sprinkler heads 168, 170. The pipe assembly 166 includes a vertical pipe section 172, a plurality of horizontal pipe sections 174, 176, 178, 180, a union 182, a cap 184, a plurality of couplings 74, 76, 186 and a pair of elbows 188, 190. The elbows 188, 190 position the sprinkler heads 168, 170 in a pendant position to provide water coverage that impinges on the bearings (not shown) of the head assembly (not shown) for the conveyor 10 shown in FIG. 1.

The configuration of the station 164 shown in FIG. 17 is particularly suitable for in mine locations in which the ceiling is close to the conveyor 10 shown in FIG. 1. In such locations, the horizontal pipe sections 176, 178, 180 must be installed as close as possible to the mine ceiling to prevent damage from objects being transported by the conveyor 10.

Figure 18:
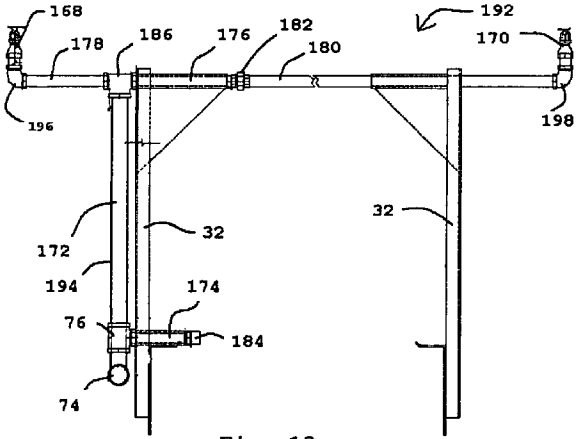
FIG. 18 is an elevational view of another embodiment of a fire suppression system station for providing protection for the conveyor head pulley.

Referring now to FIG. 18, there is shown another embodiment of a fire suppression system station, generally designated by the numeral 192 in which like elements are identified by like numerals shown in FIGS. 1-17. The station 192 includes a pair of bracket assemblies 32, a pipe assembly 194, and a pair of sprinkler heads 168, 170. Contrary to the embodiment shown in FIG. 17, the pipe assembly 194 includes a pair of elbows 196, 198 that direct the sprinkler heads 168, 170 in an upward direction.

The station 192 shown in FIG. 18 provides fire suppression at mine locations where the pipe assembly 194 is unlikely to be damaged by objects traveling on the conveyor 10 shown in FIG. 1. The sprinkler heads 168, 170 are positioned in a pendant position to provide water coverage that impinges on the bearings (not shown) of the head assembly (not shown) of the conveyor 10.

Figure 20:
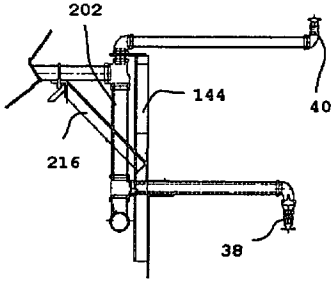
FIG. 20 is an elevational view of the fire suppression system station shown in FIG. 19, illustrating an optional brace.
Figure 19:
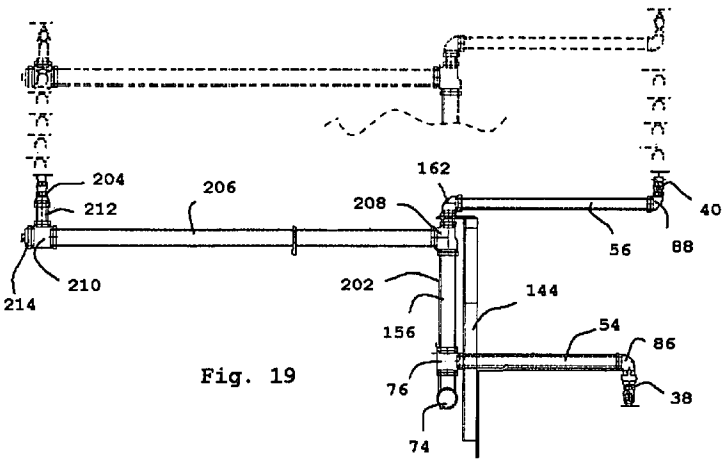
FIG. 19 is an elevational side view of an embodiment of a fire suppression system station, illustrating a number of adjustable positions for multiple sprinkler heads to provide fire protection over a motor assembly of the conveyor.

Referring now to FIGS. 19-20, there is shown another embodiment of a fire suppression system station generally designated by the numeral 200 in which like elements are identified by like numerals shown in FIGS. 1-18. The station 200 provides additional fire protection over the conveyor motor assembly (not shown) in mine locations that have low ceilings.

The station 200 includes a bracket assembly 144, a pipe assembly 202, and a plurality of sprinkler heads 38, 40, 204. The pipe assembly 202 includes a vertical pipe section 156, a plurality of horizontal pipe sections 54, 56, 206, a plurality of couplings 74, 76, 208, 210, a plurality of elbows 86, 88, 162 and a sprig 212. The vertical pipe section 156 is selective in length as shown in FIGS. 16 and 19, as is the support column 152 of bracket assembly 144 as shown in FIGS. 14 and 15. This enables the sprinkler head 40, for example, to be positioned at a preselected height above the conveyor. The selective positioning of the sprinkler head 40 is shown in phantom in FIG. 16. The coupling 208 connects to the horizontal pipe section 206 to supply water to the sprinkler head 204 through the coupling 210 and the sprig 212. The coupling 210 includes a plug 214, which allows additional sprinklers or sprinkler heads to be added as needed. The sprinkler head 204 is positioned over the conveyor motor assembly (not shown).

The station 200 includes the same protection for the pipe assembly 202 that is shown in FIG. 16. The elbow 162 allows the horizontal pipe section 56 to rotate about the vertical pipe section 156 out of the path of an object (not shown) traveling at a predetermined height on the conveyor belt 128 shown in FIG. 1. Optionally, the station 200 includes a brace 216 for supporting the bracket assembly 144.

Figure 21:
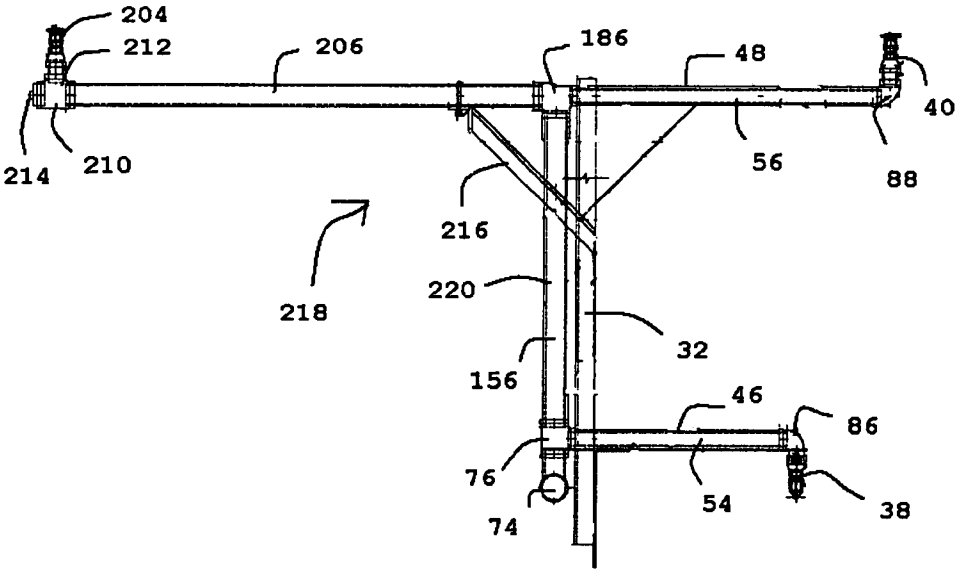
FIG. 21 is an elevational view of another embodiment of a fire suppression system station for providing fire protection over the conveyor motor assembly.

Now referring to FIG. 21, there is shown another embodiment of a fire suppression system station, generally designated by the numeral 218, in which like elements are identified by like numerals shown in FIGS. 1-20. The station 218 includes a bracket assembly 32, a pipe assembly 220, and a plurality of sprinkler heads 38, 40, 204.

The station 218 provides fire suppression protection to the conveyor motor assembly (not shown) in mine locations where the ceiling height is sufficient that the pipe assembly 220 is unlikely to be damaged by objects being transported on the conveyor 10 shown in FIG. 1.

The pipe assembly 220 shown in FIG. 21 connects to the bracket assembly 32 by inserting the horizontal sprinkler pipe sections 54, 56 into the horizontal tubular members 46, 48. The pipe assembly 220 includes a rigid coupling 186 that connects to the horizontal pipe section 206 to provide water to the sprinkler head 204, which is positioned over the conveyor motor assembly (not shown).

Figure 24:
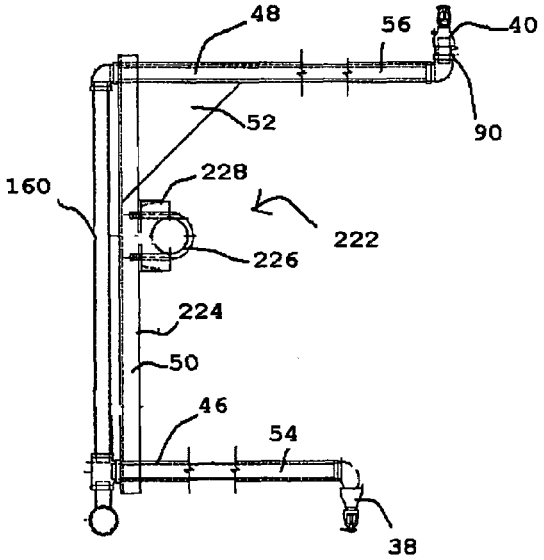
FIG. 24 is an elevational view of a fire suppression system station mounted on the bracket assembly shown in FIGS. 22 and 23.
Figure 25:
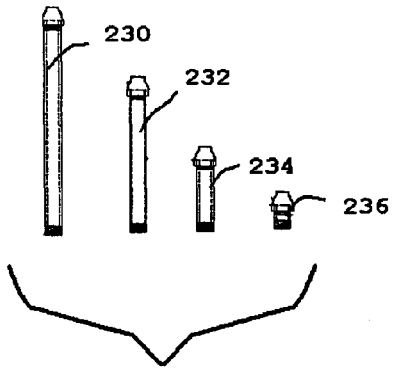
FIG. 25 is an elevational view of a plurality of sprinkler heads of varying lengths for positioning on the fire suppression system station shown in FIG. 24.

Referring now to FIGS. 22-25, there is shown another embodiment of a fire suppression system station generally designated by the numeral 222 in FIG. 24 in which like elements are identified by like numerals shown in FIGS. 1-21. The station 222 is specially adapted to support piping that exceeds the allowable unsupported lengths.

The station 222 shown in FIG. 24 includes a bracket assembly 224, a pipe assembly 160, a fastener 226, and a pair of sprinkler heads 38, 40. The bracket assembly 224 includes a pair of tubular horizontal members 46, 48, a vertical support column 50, a gusset 52, and a bracket plate 228 connected to the support column 50. The pipe assembly 160 connects to the bracket assembly 224 by inserting a pair of horizontal pipe sections 54, 56 into the tubular horizontal members 46, 48.

In comparison with the embodiment shown in FIGS. 5-9, the fastener 226 includes a U-bolt that connects to the plate 228 to connect the station 222 to fasten to a pipe conveyor (not shown), as opposed to a channel conveyor. Optionally, the pipe assembly 160 includes sprigs 230, 232, 234, 236 of varying size for optimal positioning of the sprinkler head 40 in the crosscut or entry (not shown).

Figure 26:
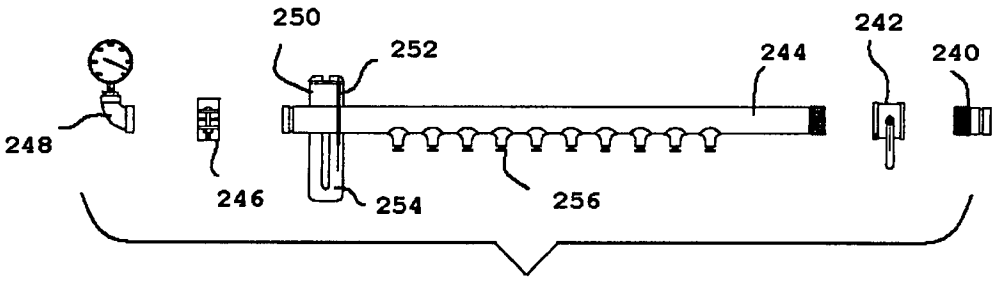
FIG. 26 is an exploded view of test equipment for the fire suppression system shown in FIGS. 3-4.
Figure 22:
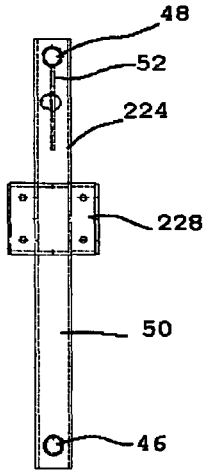
FIG. 22 is a side view of bracket assembly for use in a fire suppression system station having a U-bolt fastener.
Figure 23:
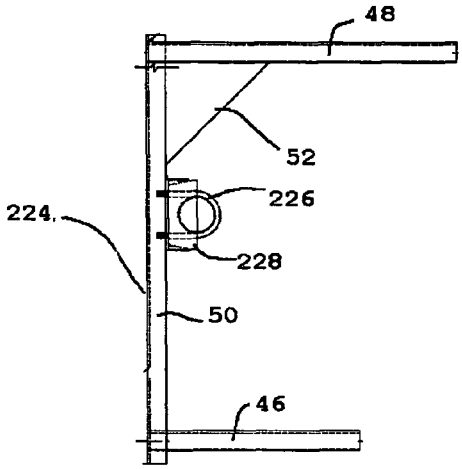
FIG. 23 is an elevational view of the bracket assembly shown in FIG. 22, illustrating a U-bolt fastener.

Referring now to FIG. 26, there is shown a testing device generally designated by the numeral 238 for use with the fire suppression system described in FIGS. 1-25. The testing device 238 includes a coupling 240, a ball valve 242, an outlet manifold 244, a coupling 246, a pressure gauge assembly 248, and a bracket assembly 250. The valve 242 controls the testing process.

The coupling 240 and the ball valve 242 connect the testing device 238 to the system 30 shown in FIGS. 3-4. The ball valve 242 connects to the outlet manifold 244. The Grinnell coupling 246 connects the pressure gauge assembly 248 to the outlet manifold 244. The bracket assembly 250 includes a plate 252 and a bracket 254 for mounting the testing device 238.

The outlet manifold 244 includes a plurality of orifices 256 that have predetermined dimensions. The number and dimensions of the orifices 256 are preselected in relation with the hydraulic demand of the system 30 shown in FIGS. 3-4. The pressure gauge assembly 248 measures the pressure of the system to verify that that the system 30 has an adequate water supply and the ability to provide water for fire suppression. The outlet manifold orifices 256 also flush the system 30, as necessary.

According to the provisions of the patent statutes, we have explained the principle, preferred construction and mode of operation of our invention and have illustrated and described what we now consider to represent its best embodiments. However, it should be understood that, within the scope of the appended claims, the invention may be practiced otherwise than as specifically illustrated and described.

We claim:

1. A modular fire suppression apparatus, comprising:

a bracket assembly, comprising:

a vertical member;

a first horizontal member connected to and extending from the vertical member in a horizontal direction;

a second horizontal member connected to and extending from the vertical member in the horizontal direction, the second horizontal member being vertically spaced above the first horizontal member;

a bracket connected between the vertical member and the first horizontal member, the bracket being configured to mount the bracket assembly on a support, wherein the bracket includes a vertical plate connected to the vertical member and a horizontal plate extending from the vertical plate in the horizontal direction; and at least one fastener configured to engage the bracket to connect the bracket assembly to the support;

a pipe assembly supported by the bracket assembly, including:

a coupling configured to connect the pipe assembly to a source of fire suppressing fluid under pressure;

at least one vertical pipe adjacent to and extending along the vertical member of the bracket assembly, the at least one vertical pipe being in fluid communication with the coupling;

a first horizontal pipe extending along and parallel to the first horizontal member of the bracket assembly in the horizontal direction and supported on the first horizontal member, the first horizontal pipe being in fluid communication with the coupling;

a second horizontal pipe extending along and parallel to the second horizontal member of the bracket assembly in the horizontal direction and supported on the second horizontal member, the second horizontal pipe being in fluid communication with the coupling via the at least one vertical pipe;

at least one spraying device disposed on and in fluid communication with the first horizontal pipe and configured to spray the fire suppressing fluid; and at least one spraying device disposed on and in fluid communication with the second horizontal pipe and configured to spray the fire suppressing fluid, wherein the first horizontal pipe is configured to convey the fire suppressing fluid in the horizontal direction from the coupling to the at least one spraying device disposed on and in fluid communication with the first horizontal pipe, and wherein the second horizontal pipe is configured to convey the fire suppressing fluid in the horizontal direction from the coupling via the at least one vertical pipe to the at least one spraying device disposed on and in fluid communication with the second horizontal pipe, wherein the at least one spraying device disposed on and in fluid communication with the first horizontal pipe and the at least one spraying device disposed on and in fluid communication with the second horizontal pipe are supported by the bracket assembly to be vertically spaced apart.

2. The modular fire suppression apparatus according to claim 1, wherein the first and second horizontal members of the bracket assembly are tubular horizontal members, each of the tubular horizontal members having a longitudinal axis extending from the vertical member of the bracket assembly in the horizontal direction, and wherein the first horizontal pipe extending along and supported on the first horizontal member is inserted into the first horizontal member, and the second horizontal pipe extending along and supported on the second horizontal member is inserted into the second horizontal member.

3. The modular fire suppression apparatus according to claim 1, wherein the at least two spraying devices each include a sprinkler head for receiving the fire suppressing fluid from the pipe assembly, and wherein each sprinkler head of the at least two spraying devices is positioned with respect to the apparatus to spray the fire suppressing fluid in a preselected direction.

4. The modular fire suppression apparatus according to claim 3, wherein the sprinkler head of the at least one spraying device disposed on and in fluid communication with the second horizontal pipe is positioned to spray the fire suppressing fluid above the apparatus and the sprinkler head of the at least one spraying device in fluid communication with the first horizontal pipe is positioned to spray the fire suppressing fluid below the apparatus.

5. The modular fire suppression apparatus according to claim 1, wherein the at least one fastener includes a J-bolt.

6. The modular fire suppression apparatus according to claim 1, wherein the bracket includes the vertical plate directly connected to the vertical member and the horizontal plate directly connected to the first horizontal member, wherein the vertical plate and the horizontal plate are both configured to engage the support such that the bracket assembly is in an upstanding relationship with respect to the support, and wherein the at least one fastener is configured to engage the vertical and horizontal plates of the bracket and the support.

7. A kit for assembling a modular fire suppression apparatus, comprising:

a bracket assembly, comprising:

a vertical member;

a first horizontal member connected to and extending from the vertical member in a horizontal direction;

a second horizontal member connected to and extending from the vertical member in the horizontal direction, the second horizontal member being vertically spaced above the first horizontal member; and a bracket connected between the vertical member and the first horizontal member, the bracket being configured to mount the bracket assembly on a support, wherein the bracket includes a vertical plate connected to the vertical member and a horizontal plate extending from the vertical plate in the horizontal direction; and at least one fastener configured to engage the bracket to connect the bracket assembly to the support;

a pipe assembly supported by the bracket assembly, including:

a coupling configured to connect the pipe assembly to a source of fire suppressing fluid under pressure;

at least one vertical pipe adjacent to and extending along the vertical member of the bracket assembly, the at least one vertical pipe being in fluid communication with the coupling;

a first horizontal pipe extending along and parallel to the first horizontal member of the bracket assembly in the horizontal direction and supported on the first horizontal member, the first horizontal pipe being in fluid communication with the coupling;

a second horizontal pipe extending along and parallel to the second horizontal member of the bracket assembly in the horizontal direction and supported on the second horizontal member, the second horizontal pipe being in fluid communication with the coupling via the at least one vertical pipe;

at least one spraying device disposed on and in fluid communication with the first horizontal pipe and configured to spray the fire suppressing fluid; and at least one spraying device disposed on and in fluid communication with the second horizontal pipe and configured to spray the fire suppressing fluid, wherein the first horizontal pipe is configured to convey the fire suppressing fluid in the horizontal direction from the coupling to the at least one spraying device disposed on and in fluid communication with the first horizontal pipe, and wherein the second horizontal pipe is configured to convey the fire suppressing fluid in the horizontal direction from the coupling via the at least one vertical pipe to the at least one spraying device disposed on and in fluid communication with the second horizontal pipe, wherein the at least one spraying device disposed on and in fluid communication with the first horizontal pipe and the at least one spraying device disposed on and in fluid communication with the second horizontal pipe are supported by the bracket assembly to be vertically spaced apart.

8. The kit according to claim 7, further comprising:

a monitoring device configured to connect to the pipe assembly to measure the flow of fire suppressing fluid through the pipe assembly.

9. The kit according to claim 7, further comprising:

a testing device configured to connect to the pipe assembly to verify that the apparatus has an adequate supply of fire suppressing fluid.

10. A fire suppression station for an underground mine conveyor, comprising:

a bracket assembly, comprising:

a vertical member;

a first horizontal member connected to and extending from the vertical member in a horizontal direction;

a second horizontal member connected to and extending from the vertical member in the horizontal direction, the second horizontal member being vertically spaced above the first horizontal member; and a bracket connected between the vertical member and the first horizontal member, the bracket being configured to mount the bracket assembly on a support, wherein the bracket includes a vertical plate connected to the vertical member and a horizontal plate extending from the vertical plate in the horizontal direction; and at least one fastener configured to engage the bracket to connect the bracket assembly to the support;

a pipe assembly supported by the bracket assembly, including:

a coupling configured to connect the pipe assembly to a source of fire suppressing fluid under pressure;

at least one vertical pipe adjacent to and extending along the vertical member of the bracket assembly, the at least one vertical pipe being in fluid communication with the coupling;

a first horizontal pipe extending along and parallel to the first horizontal member of the bracket assembly in the horizontal direction and supported on the first horizontal member, the first horizontal pipe being in fluid communication with the coupling;

a second horizontal pipe extending along and parallel to the second horizontal member of the bracket assembly in the horizontal direction and supported on the second horizontal member, the second horizontal pipe being in fluid communication with the coupling via the at least one vertical pipe;

at least one spraying device disposed on and in fluid communication with the first horizontal pipe and configured to spray the fire suppressing fluid; and at least one spraying device disposed on and in fluid communication with the second horizontal pipe and configured to spray the fire suppressing fluid, wherein the first horizontal pipe is configured to convey the fire suppressing fluid in the horizontal direction from the coupling to the at least one spraying device disposed on and in fluid communication with the first horizontal pipe, and wherein the second horizontal pipe is configured to convey the fire suppressing fluid in the horizontal direction from the coupling via the at least one vertical pipe to the at least one spraying device disposed on and in fluid communication with the second horizontal pipe, wherein the at least one spraying device disposed on and in fluid communication with the first horizontal pipe and the at least one spraying device disposed on and in fluid communication with the second horizontal pipe are supported by the bracket assembly to be vertically spaced apart.

* * * * *